United States Patent [19]

Miller et al.

[11] 4,330,899

[45] May 25, 1982

[54] NOISE REDUCING BLOWER MOTOR HOUSING MEANS FOR VACUUM CLEANER, OR THE LIKE

[75] Inventors: Jonathan Miller; Richard Fegan, both of Williamsport; Robert C. Berfield, Jersey Shore; Kenneth R. Hiester, Cogan Station; Rudolph W. Wacek, Montoursville, all of Pa.

[73] Assignee: Shop-Vac Corporation, Williamsport, Pa.

[21] Appl. No.: 141,567

[22] Filed: Apr. 18, 1980

[51] Int. Cl.[3] ..... A47L 9/22

[52] U.S. Cl. ..... 15/326; 15/413; 55/276; 417/312; 417/368

[58] Field of Search ..... 15/326, 413, 353; 55/276; 417/312, 368

[56] References Cited

U.S. PATENT DOCUMENTS

| | | | |
|---|---|---|---|
| 2,731,194 | 1/1956 | Kent | 417/312 |
| 3,780,397 | 12/1973 | Harbeck et al. | 15/413 |
| 3,848,290 | 11/1974 | Bates | 15/413 X |
| 4,114,231 | 9/1978 | Nauta | 15/413 |
| 4,195,969 | 4/1980 | Whitney | 417/312 X |
| 4,213,224 | 7/1980 | Miller | 15/344 |
| 4,280,245 | 7/1981 | Hiester | 15/326 |

FOREIGN PATENT DOCUMENTS

| | | |
|---|---|---|
| 739737 | 9/1953 | United Kingdom . |
| 1080851 | 7/1966 | United Kingdom . |

*Primary Examiner*—Chris K. Moore

*Attorney, Agent, or Firm*—Ostrolenk, Faber, Gerb & Soffen

[57] ABSTRACT

The disclosure concerns a housing for reducing the noise and exhaust air velocity of a bypass type blower motor, particularly a motor used for a tank type vacuum cleaner. The entire housing sits atop the lid of the tank of the vacuum cleaner. The bypass type blower motor has a main, suction generating, centrifugal blower fan and a separate motor cooling fan. Outlet from the main blower fan is into a first expansion chamber above the lid. A spiral pathway baffle in the first expansion chamber defines a gradually increasing cross-section plenum which communicates from the fan to the outlet from the first expansion chamber. There is a tubular outlet from the first expansion chamber which is surrounded by a sound baffling cuff of foamed plastic material. A cooling air inlet to the motor cooling fan and a separate cooling air outlet from the casing for the motor cooling fan are provided. A second expansion chamber communicates with the cooling air outlet from the casing for receiving the exhausted motor cooling air. The second expansion chamber separates the inlet to the motor cooling fan from the outlet from the motor casing for the cooling air. The outlet for the exhausted cooling air from the second expansion chamber faces in the same direction as the inlet to the motor cooling fan. A cover passes over the cooling air inlet and outlet. A baffle between the second expansion chamber and the cover separates the air flows to the cooling air inlet and outlet.

28 Claims, 18 Drawing Figures

FIG. 11.
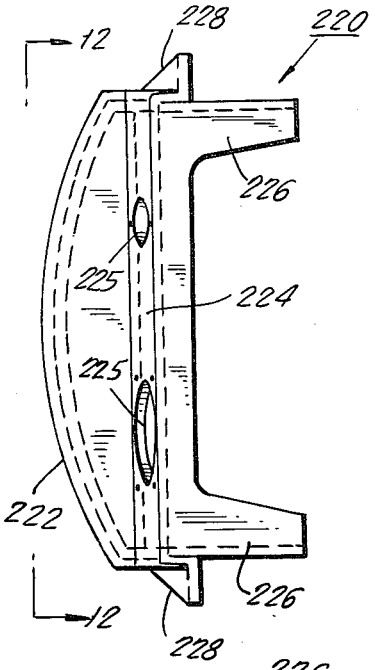
FIG. 12.
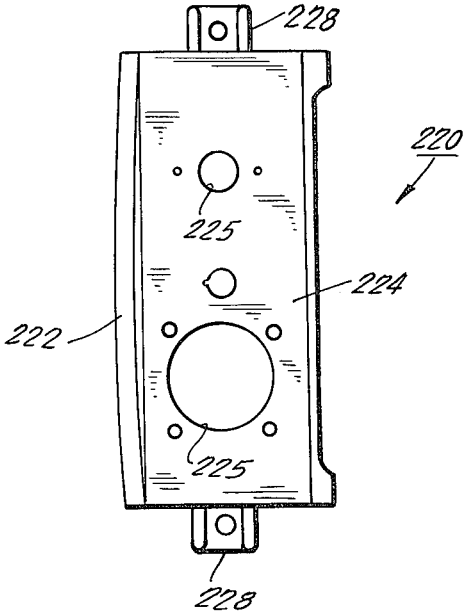
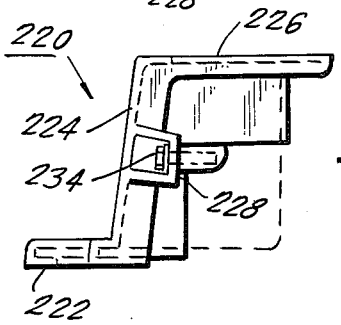
FIG. 10.
FIG. 9.
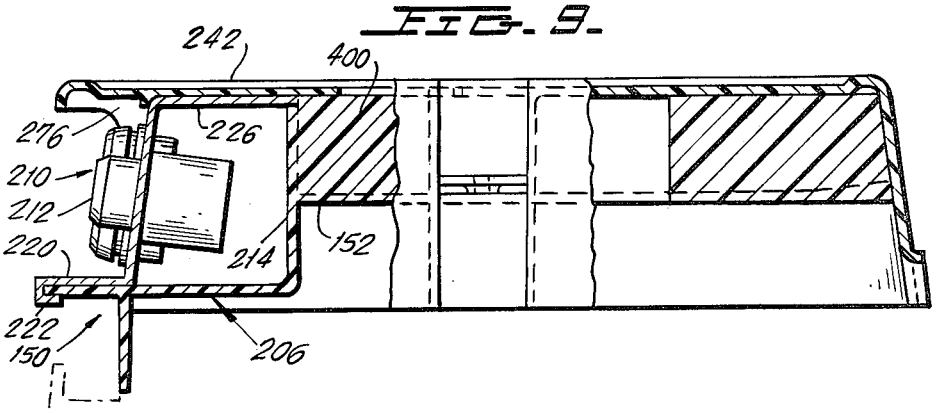

NOISE REDUCING BLOWER MOTOR HOUSING MEANS FOR VACUUM CLEANER, OR THE LIKE

BACKGROUND OF THE INVENTION

The present invention relates to noise reducing housing means for a blower motor, which is particularly useful for a vacuum cleaner.

A blower motor includes a motor, typically electric, and a fan driven by the motor for moving air, gas, or the like. Blower motors are often used in vacuum cleaners for sucking air and collected materials into a tank or receptacle. The fan drive motor of the blower motor should be cooled. In bypass type blower motors, a separate smaller fan connected with the fan drive motor blows cooling air over the motor. The flow of motor cooling air is kept separate from the air flow developed by the main blower fan.

It is desirable in a bypass type blower motor, that the air flow through the main blower fan, and particularly from the exhaust of the main blower fan, be kept separated from the motor cooling air flow. Accordingly, housings for supporting the bypass type electric motors and for separating the air flows thereof have been developed, as shown in U.S. Pat. Nos. 3,780,397 and 3,815,172. See also U.S. Pat. Nos. 3,870,486 and 3,063,082.

It is desirable to reduce the noise generated by a blower motor, such as one used in an electric vacuum cleaner. Noise reduction requirements have been mandated for industry and are desirable in domestic applications, particularly with respect to electric vacuum cleaners. Typical blower motor housings, like those used in vacuum cleaners, do not adequately suppress noise. Various noise suppression means are known, but they often reduce the rate of air flow. For obtaining a higher rate air flow, a larger, stronger blower motor is needed, resulting in increased energy costs, or the present blower motor is strained, leading to greater heating or even overheating thereof. Adequate means for suppressing the noise of a blower motor, particularly for an electric vacuum cleaner, without reducing the efficiency of the motor are therefore desirable.

One technique for reducing the noise generated by a blower motor is to reduce the velocity of the air exiting from the housing of the blower motor. This velocity reduction may be obtained by use of expansion chambers or by appropriate baffles in the path of the air. Making the pathway of the exiting air a tortuous or winding pathway also helps reduce the speed of the air and tends to suppress the noise carried along by the air flow. Note the spiral outlets from the blower motor fans shown in U.S. Pat. Nos. 2,982,986 and 2,983,432.

Another technique for reducing noise generated by a blower motor is to move the air over appropriate sound deadening material. The contact of the air with the sound deadening material will tend to reduce the vibration of the air and suppress the motor noise carried along by and conducted by the moving air. Sound absorbing cuffs, or the like, in the flow path of air are known from U.S. Pat. Nos. Re. 21,519; 2,330,701; 3,831,233; and 4,015,683.

However, an effective complete noise suppressing housing means for a blower motor, particularly for use on electric vacuum cleaners has not previously been developed.

SUMMARY OF THE INVENTION

It is the primary object of the present invention to suppress the noise in the ambient environment, which noise has been produced by a blower motor, and particularly a bypass type blower motor.

It is another object of the invention to provide such means particularly for use in conjunction with electric vacuum cleaners.

It is a further object of the invention to provide housing means which accomplish the noise suppression purpose.

It is another object of the invention to suppress the noise generated by a blower motor without excessively stressing the blow motor or creating back pressure on the motor.

According to the present invention, noise suppression is accomplished by housing means for housing the bypass type blower motor. The housing means includes various noise suppression means which together cooperate to reduce the noise generated by the blower motor. The housing means may be supported on the tank of an electric vacuum cleaner, or the like apparatus for which the bypass type blower motor is used.

The blower motor has an inlet to the main blower fan, an outlet from the main blower fan, a separate inlet for cooling air to the motor and a separate outlet for cooling air from the motor. The bypass type motor itself is internally designed to separate its own air flows between the air flow through the main blower fan and the cooling air flow for the motor. Typically, the main blower fan is a centrifugal fan, expelling the air from the periphery of the housing of the motor all around the motor.

The housing means defines a first expansion chamber into which the outlet flow from the main centrifugal blower fan empties. The first expansion chamber defines an enlarged volume, and this slows the velocity of the air, thereby helping to suppress noise. Appropriate baffle means in the first expansion chamber intercept the flow from the main blower fan and redirect that flow, thereby also helping to suppress the noise of the vacuum cleaner. The baffle means are preferably arranged in a spiral around the blower fan, which spiral is shaped to define a gradually increasing volume plenum leading to the outlet from the first expansion chamber to the environment. The gradually increasing volume plenum reduces the velocity of the air and the spiral pathway redirects the flow of the air, which together tends to slow the air, reduce the vibration of the air and reduce the motor noise.

At the larger section of the plenum, the outlet from the first expansion chamber to the environment is provided. This outlet is provided with a tubular outlet fitting that projects into the large volume section of the plenum. This fitting is surrounded by a cuff of air flowing velocity damping and noise and vibration damping material, such as porous foamed plastic material. The cuff may be supported by a cage with large openings therein for permitting access between the air flowing through the outlet fitting and the damping material. The projection of this fitting into the large portion of the plenum causes the air flowing through the plenum again to be redirected in order to exit from the outlet and further suppresses the noise and vibration as the air passes out the tubular fitting.

It is contemplated by the inventors hereof that the combination of all of the above described features of the first expansion chamber will have the quite beneficial effect of reducing the velocity of the air exhausted by the main blower fan, will reduce the noise that is generated at the main blower fan and will do this without creating a significant back pressure and without straining the motor that drives the main blower fan.

The separate bypass motor cooling air flow exhausts from the casing of the motor into a second expansion chamber, which is separated from the first expansion chamber. The second expansion chamber also defines an enlarged volume into which the motor cooling air is exhausted. The considerable volume of the second expansion chamber tends to slow the velocity of the motor cooling air, thereby reducing the noise. There is an outlet from the second expansion chamber to the environment. The inlet of motor cooling air to the blower motor casing is through an inlet located at the second expansion chamber. The casing inlet communicates externally of the second expansion chamber and communicates to the motor casing.

An appropriate protective cover over the inlet to the casing for motor cooling air flow and over the outlet for cooling air from the casing provides protection against ambient conditions. Appropriate baffle means are provided under that cover for separating the inflowing and exiting motor cooling air. The cover also serves to baffle the exiting flow of air from the outlet from the second expansion chamber, and in doing so, it redirects that air flow, further reducing its velocity and also reducing the noise carried along by that air.

The bypass motor is so oriented and the expansion chambers are so located that the first expansion chamber is above the lid over the tank of the vacuum cleaner and the inlet to the main blower fan communicates through the lid into the tank. The second expansion chamber is above the first expansion chamber and the cover is spaced above the second expansion chamber for defining the air inlet and outlet passages of the second expansion chamber.

In the preferred embodiment of the housing means, the first expansion chamber is defined under a first or lower housing which sits upon the lid and the first expansion chamber is defined inside that lower housing above the lid. The second expansion chamber is defined between the lower housing and an upper housing that sits atop the lower housing. The cover is a separate unit above the upper housing. The cover and the upper and lower housings are fastened together and to the lid over the tank of the electric vacuum cleaner.

By the use of expansion chambers, baffles and the noise and vibration suppressing tubular outlet fitting of the first expansion chamber, the housing means of the present invention effectively suppresses the noise that is typically associated with a bypass type blower motor, particularly on electric vacuum cleaners.

Other objects and features of the present invention will become apparent from the following description of the accompanying drawings.

BRIEF DESCRIPTION OF THE DRAWINGS

FIG. 9 is a side elevational view in cross-section showing the upper housing and its connection with the cover thereover and viewed in the direction of arrows 9—9 of FIG. 13;

FIG. 10 is a side elevational view of the covering panel over the electrical box of the upper housing;

FIG. 11 is a top plan view of the cover of FIG. 10;

FIG. 12 is a front view of the electric panel cover of FIG. 10;

DESCRIPTION OF PREFERRED EMBODIMENTS

Figure 1:
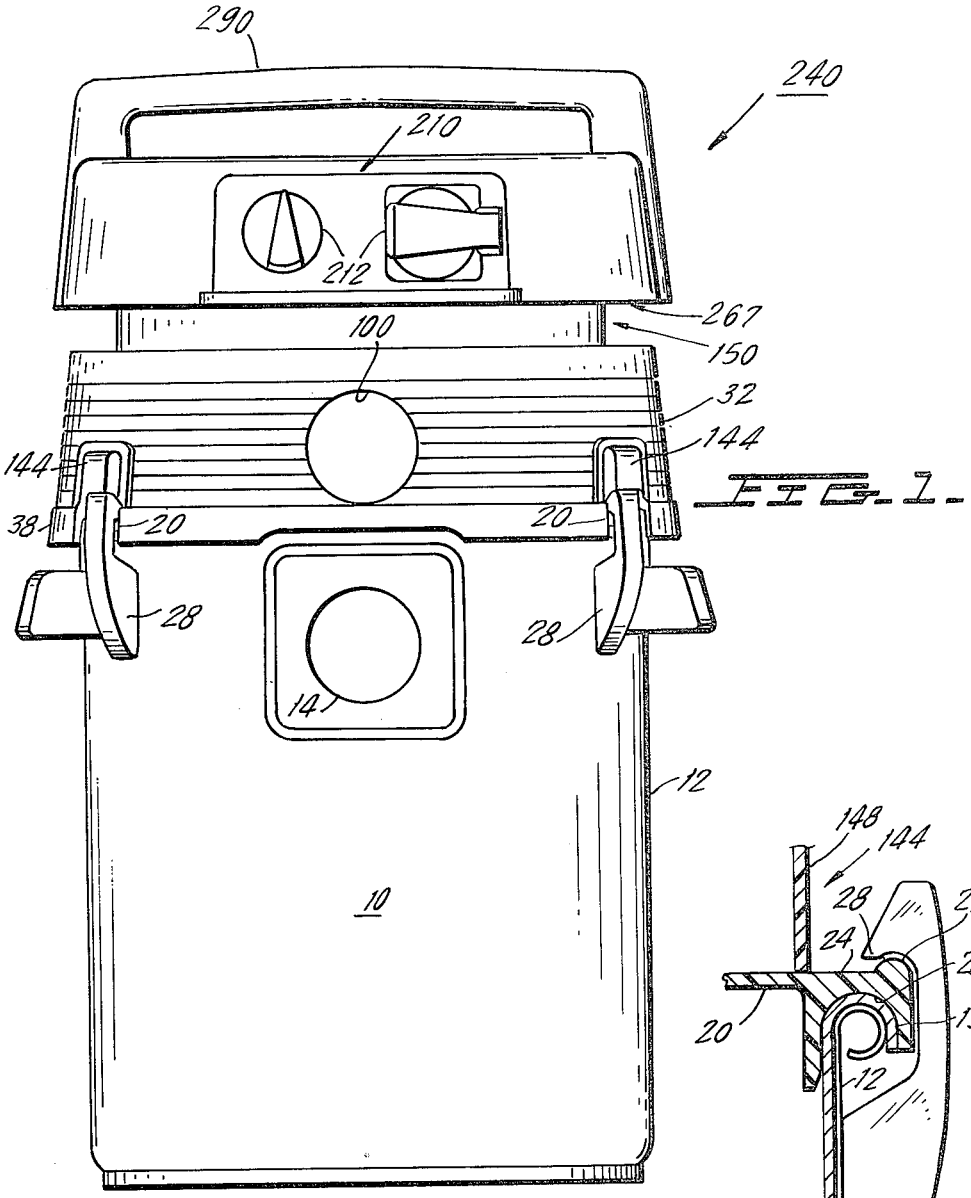
FIG. 1 is a front elevational view of an electric vacuum cleaner provided with the noise suppressing housing means according to the present invention.

The vacuum cleaner according to the invention is comprised of a number of subassemblies, including bypass type blower motor 50, the tank 10 for receiving collected materials; the lid 20 over the tank; the lower housing 30 over the lid, which provides a support for the bypass type blower motor and main blower fan 54, provides a sound muffling outlet passageway for the air exhausted by the main blower fan 54 and defines the bottom of the outlet chamber for motor cooling air that is exhausted from the blower motor casing; the upper housing 150 or 300, which separates the inflowing motor cooling air from the motor cooling air that has been exhausted from the motor casing and defines an exhaust chamber for slowing the flow of motor cooling air that has been exhausted form the motor casing; the upper housing having baffle means defined thereon for separating the cooling air inflow and outflow from the bypass type blower motor; the upper housing also supporting the electric components and panel of the vacuum cleaner; and a cover 240 or 350 over the entire vacuum cleaner which also cooperates with the baffle means for separating the cooling air inflow and outflow from the bypass type blower motor.

Figure 2:
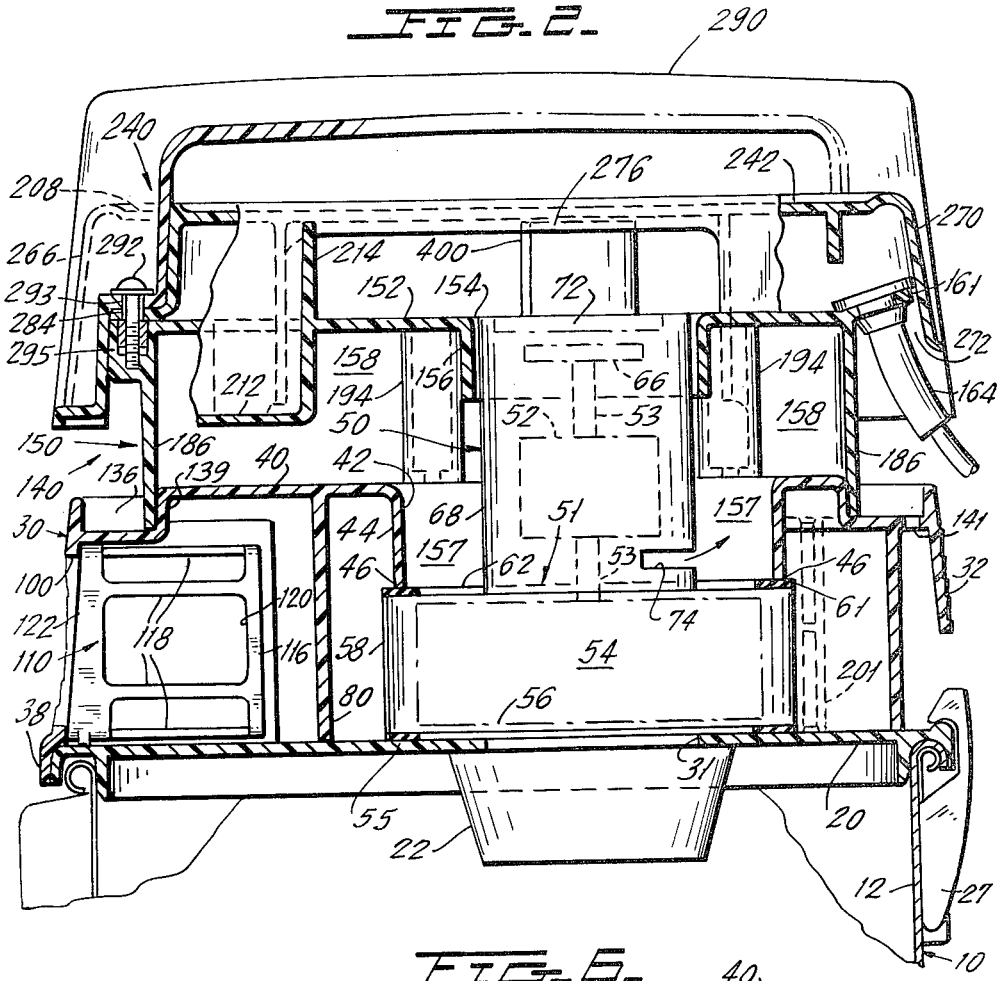
FIG. 2 is an elevational cross-sectional view into the noise suppressing housing means according to the invention.

With reference to FIGS. 1 and 2, the tank 10 is an empty container in which particulate impurities, liquids, or the like, are collected. On its side wall 12, the tank has a standard inlet fixture 14 to which a suction hose (not shown) may be connected. As the blower motor 52 and fan 54 of the vacuum cleaner operate, air and collected materials are sucked through the inlet 14 and the collected materials settle out of the air flow into the tank 10. The tank side wall 12 terminates at an annular bead 15 at the top thereof, as shown in FIG. 3.

The tank 10 is covered by a plate-like lid 20, which may be of the type shown in U.S. Pat. No. 4,185,974, granted Jan. 29, 1980, incorporated herein by reference. Of course, the lid 20 would be configured for the particular tank 10 and the hole through the lid for the filter cage 22 would be placed so that it would be beneath the blower motor.

Figure 3:
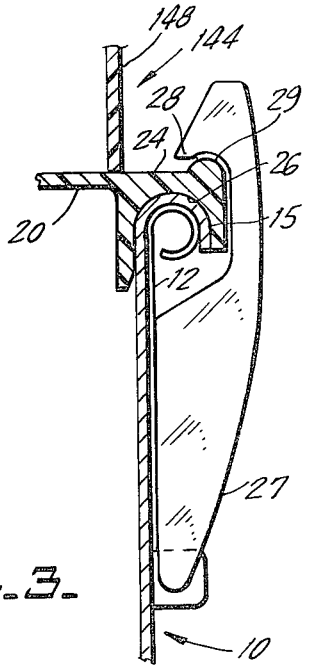
FIG. 3 is a detail showing the means for latching the lid and housing means to the tank of the electric vacuum cleaner.

As shown in FIG. 3, the lid 20 has an annular rim portion 24 with a groove 26 at the underside thereof in which the bead 15 at the top of the tank 10 is received. Three equally spaced apart conventional buckles 27 are supported on the side wall 12 of the tank and the hooks 28 of the buckles engage the top bead 29 of the peripheral rim 24 for holding the lid 20 to the tank. The lid has an opening 31 through it by which the below described main blower fan 54 communicates into the tank.

Directly above the lid 20 is the lower housing 30 shown in FIGS. 2, 4, 5 and 6. The lower housing is defined within its peripheral side wall 32, which is decoratively stepped on its exterior. The bottom of the lower housing is open, and its bottom edge is seated atop the lid 20.

Referring to FIG. 2, at the bottom of the exterior side wall 32 of the lower housing, an annular, downwardly facing shelf section 36 is defined. This rests on the peripheral rib 29 of the lid. A depending flange 38 extends down from the shelf 36 and partially covers the periphery of the lid, primarily for esthetic reasons.

The height of the lower housing 30 is selected so that it can contain the main blower fan 54 within it and can contain the entire spiral exit plenum 86, 90, 94, 96 for the air flow exhausted from the main blower fan 54. The lower housing includes a sealed top wall 40, from which the side wall 32 of the lower housing depends. The top wall 40 has an opening 42 defined in it and which is surrounded by the circular depending flange 44. The bottom edge 46 of the flange 44 extends only part way down into the lower housing 30. That flange defines the upper support for and is pressed down against the annular, resilient gasket 61 on the top side 62 of the wider lower portion of the casing 51 for the main blower fan 54. The bottom edge 46 of the flange 44 is high enough so that the annular outlet 58 from the centrifugal type fan 54 will be entirely enclosed within the lower housing and above the lid 20. The flange 44 therefore serves as a divider to separate the air exiting from the main blower fan 54 from the exhausting cooling air that has cooled the electric motor 52 and that then exits from the slot 74 in the casing 51 of the motor, as described further below.

The blower motor 50 is of bypass type and is of conventional design. It is enclosed within a casing 51. It includes a conventional electric motor 52 with a main drive shaft 53 that extends down to the centrifugal fan 54. The fan is in the lower portion of the fan casing 51. The fan casing rests against the top of the lid 20 and is held slightly above the lid and is sealed at the lid by the annular, sealing gasket 55. The centrifugal fan 54 is of conventional design. It draws air from the tank 10 through the opening 31 in the lid to the central inlet 56 to the fan. Then the fan 54 expels the air centrifugally out of the open annular side 58 of the lower portion of the blower motor casing 51. The casing lower portion has a top wall 62 carrying the gasket 61 on which the bottom edge 46 of the flange 44 rests. The contact between the flange 44, 46 and the top wall 62 of the casing 51 assures separation between the cooling air flow from the motor and the main suctioning air flow through the bypass motor.

The motor drive shaft 53 also extends up to and drives a smaller bypass air flow fan 66, which blows cooling air down over the electric motor 52.

The motor casing 51 includes a narrower, upper, cylindrical portion 68 in which the electric motor 52 is positioned. The top of that cylindrical portion 68 has openings 72 in it for inlet of cooling air. There are slot-like exhaust openings 74 at the bottom of the casing portion 68 for exhausting of the cooling air from the casing 51. The flange 44 and the casing wall 63 separate the exhausted cooling air from the air passing through the main centrifugal fan 54.

Figure 4:
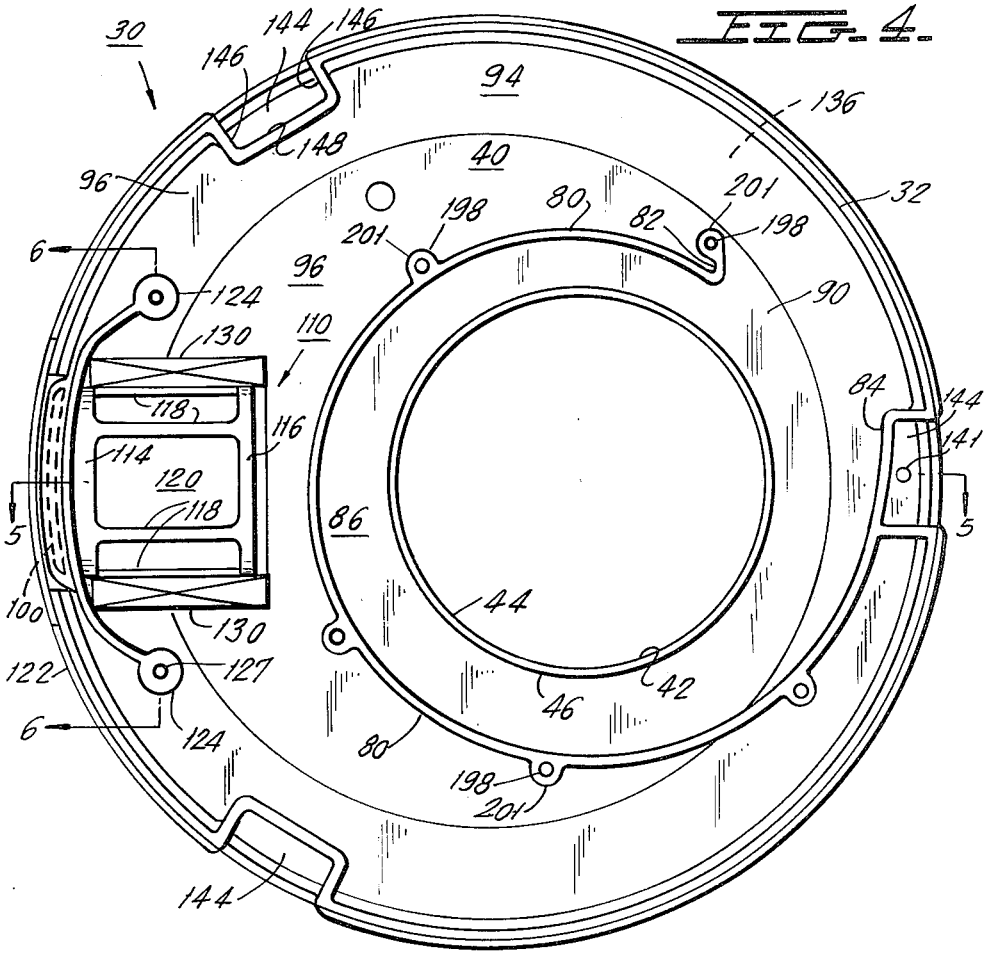
FIG. 4 is a bottom plan view of the lower housing of the housing means.
Figure 8:
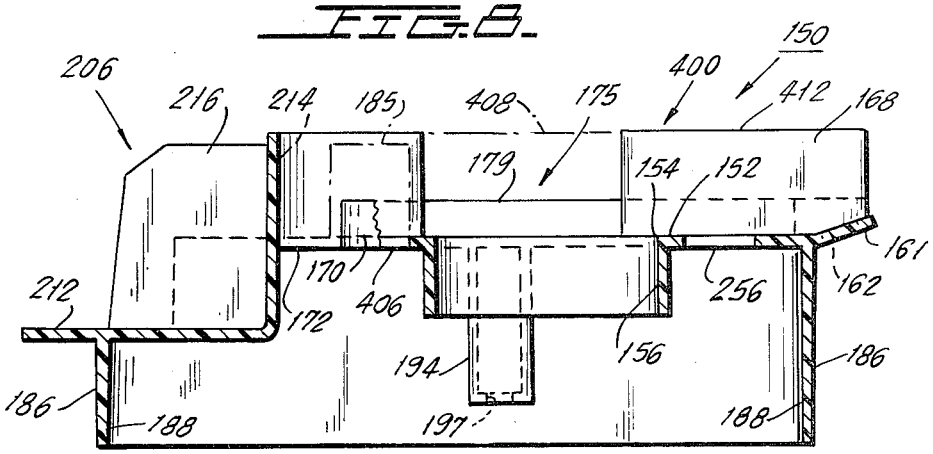
FIG. 8 is an elevational cross-sectional view of the upper housing along the pathway defined between the arrows 8—8 in FIG. 7 and in the direction of those arrows.
Figure 7:
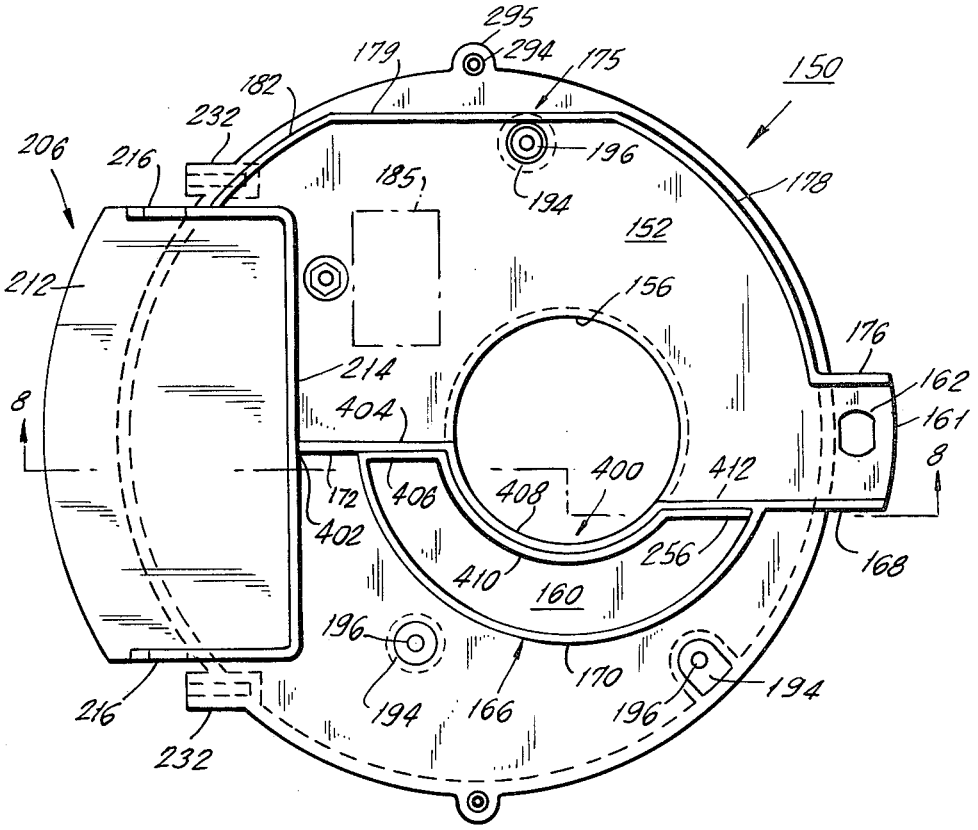
FIG. 7 is a top plan view of the upper housing of the housing means.
Figure 14:
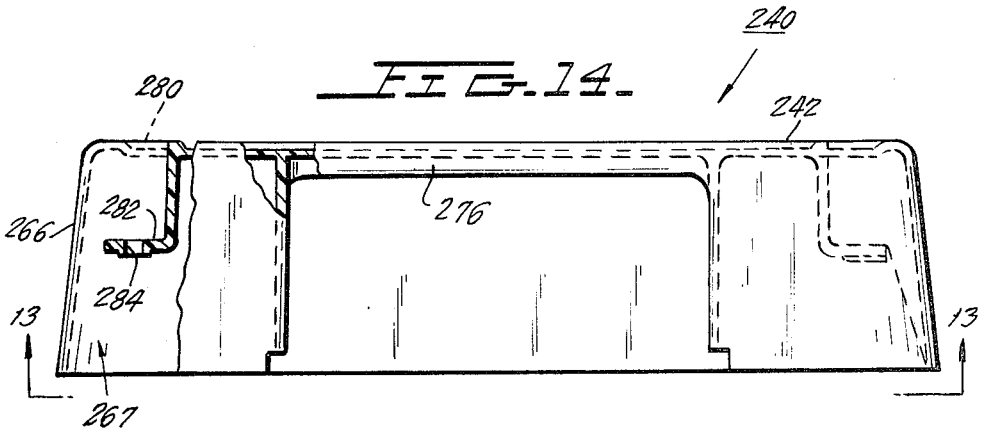
FIG. 14 is a side elevational view, partially broken away, of the cover of FIG. 13 viewed in the direction of arrows 14—14 of FIG. 13.

As noted above, the centrifugal fan 54 exhausts air centrifugally outwardly around the entire periphery 58 of the lower casing section. It is desirable to baffle this exhausting air flow, to slow it down and to also reduce the noise generated by the vacuum cleaner, but without substantially interfering with the air flow and without rendering the vacuum cleaner less efficient and also without putting undue stress on the blower motor. To this end, a generally spirally shaped baffle flange 80 is molded to and extends down from the top wall 40 of the housing 30. As shown in FIG. 4, the baffle flange 80 starts at 82, radially closer to the periphery of the centrifugal fan, and moves radially away from the periphery of the fan moving around the fan until the exit end of the flange 80 at 84. This defines a continuously widening plenum 86, which opens at the open area 90 between the flange ends 82, 84 into the plenum 94. The plenum 94 is located outside the flange 80, but inside the peripheral wall 32 of the lower housing. Because the flange 44 and thus the baffle flange 80 are laterally eccentric on the lid 30, the plenum 94 also gradually enlarges in volume until the exit section 96 thereof. The plenum 86, 90, 94, 96 defines a spiral pathway that is traveled by the air exhausting from the centrifugal fan 54. Because the plenum enlarges along the pathway toward the outlet portion 86 thereof, the velocity of the exhausting air slows, reducing the noise of the air.

Figure 6:
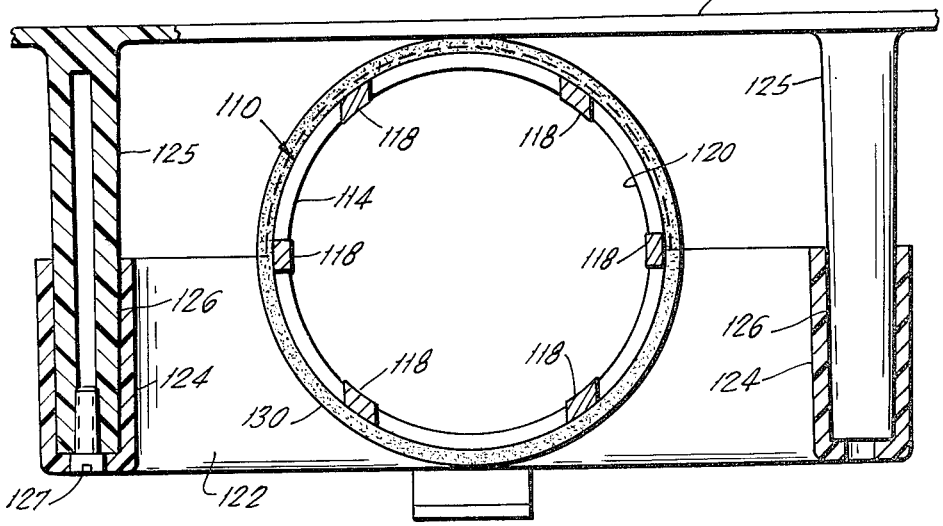
FIG. 6 is a detailed cross-sectional view along the line 6—6 in FIG. 4 showing the main outlet fitting of the lower housing.
Figure 5:
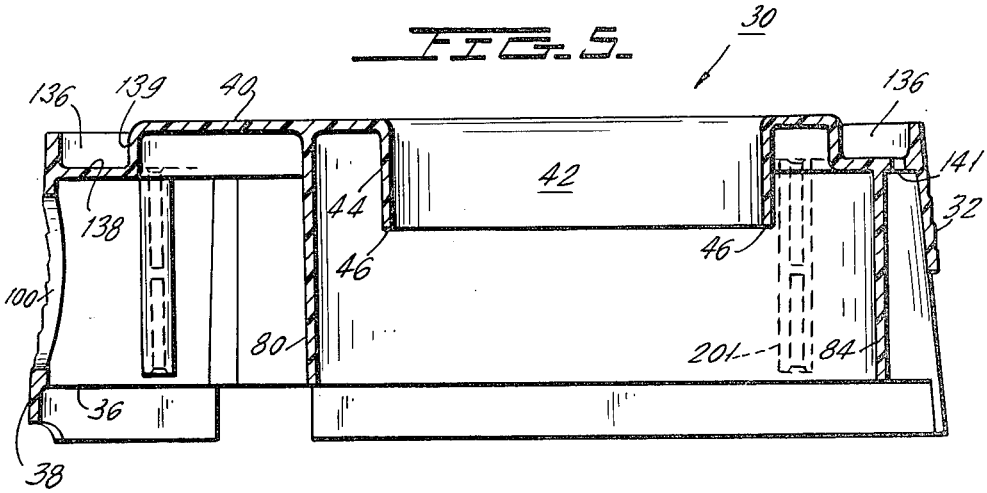
FIG. 5 is an elevational cross-sectional view of the lower housing along the line in the direction of arrows 5—5 of FIG. 4.

Outlet from the plenum 94, 96 is through the outlet opening 100 defined in the side wall 32 of the lower housing 30. Referring to FIGS. 4 and 6, for baffling that exiting air flow and reducing the noise it generates, instead of that air exiting directly out of the opening 100, a flow baffling and sound baffling means 110 is provided at the opening 100. Means 110 comprises an outer ring 14 located just inside of the lower housing opening 100 and an inner ring 116 spaced from the ring 114 further into the plenum 96, and narrow struts 18 joining the rings 114, 116, thereby defining enlarged openings 120 between the struts 118. The resulting cage is suspended beneath the top wall 40 of the lower housing. There are support straps 122 which surround the lower half of the ring 114 and these include hollow, upwardly opening bosses 124 at the ends thereof. A pair of spaced apart bosses 125 extend down from the underside of the top wall 40 at the below described cord wrap slot 136. The bosses 125 are shaped to be securely received and held inside the openings 126 in the bosses 124. Appropriate securement means 127 hold the bosses 124, 125 securely together, thereby fastening the means 110 to the top wall 40 of the lower housing.

The cage 114, 116, 118 is surrounded by the annular cuff 130 which is comprised of a layer of foamed plastic material, which may be sufficiently porous to permit air to pass through it, but which is thick enough and porous enough for baffling the flow of air through it and for muffling the motor noise carried along by the air. The cuff 130 tends to block the flow of air through itself, whereby most of the air exits through the exit 100 by first passing axially through the open cage. But, air may also pass through the foamed cuff 130. Because the foamed cuff 130 is wrapped around the cage, the cuff damps the vibration of the air inside the cage and probably also damps the vibration of the tube itself, which helps to suppress noise. In addition, because the foamed cuff 130 is located in the plenum 94, 96, as the vibrating air in the plenum approaches the outlet 100, it first contacts the cuff 130 which damps the vibration of the air, further reducing the noise of the vacuum cleaner. The combination of the plenum 94, 96 with the means 110 at the outlet 100 and the fact that the means 110 is located in the plenum 94, 96 and is exposed to the air in the plenum reduces the vibration of the air and greatly reduces the noise generated by the vacuum cleaner. In fact, with the above described structure, it is expected that the noise reduction would be greater than the noise reduction that might occur from separately using either a gradually enlarging plenum or an outlet tube that is surrounded by a foam cuff, wherein the tube has large openings in it that communicate with a surrounding foam cuff. A further benefit of the above described air outlet system is that it exerts a minimum back pressure on the main blower fan 54, because the outlet pathway for the air through the open cage is wide and because the air exits from an enlarging plenum 94, 96 which has already reduced the velocity of the air. There is, therefore, no labyrinthine passageway which the exhausting air must first travel through before exiting from the vacuum cleaner.

An annular peripheral depression 136 is defined in the top wall 40 and it extends down to the ledge 138. The depression is closed by an annular internal wall 139 which cooperates with the below described upper housing 150 at flange 186. The depression 136 defines an electric power cord wrap slot. The upper housing 150 and the cover 240 over the upper housing are shaped so as to provide a large access opening 140 to the cord wrap slot. There is a hole 141 at the underside of the depression 136 for the escape of any accumulated water.

The exterior peripheral wall 32 of the lower housing 30 has three equally spaced apart depressions 144 defined in it and extending partway up the side thereof from the bottom for providing a clearance space for the clamps or buckles 27, 29 that hold the lid 20 to the tank 10. The depressions are closed by their side walls 146 and by their interior walls 148 prohibiting access into the interior of the lower housing through the depressions 144.

With reference to FIGS. 2, 7, 8 and 9, the upper housing 150 cooperates with the lower housing 30 and with the narrowed motor casing section 68 for defining a pathway for cooling air for cooling the blow motor 52. The upper housing includes a substantially flat top wall 152. A circular opening 154 is defined in the upper wall 152 by a depending sleeve 156 for surrounding the top portion of the exterior of the motor casing section 68. The diameter of the opening 154 is substantially the same as the outer diameter of the casing section 68, for eliminating leakage of air along the casing 68 and between the cooling air inlet and outlet through the casing. The engagement between the depending flange 156 and the side of the casing section 68 is not a secure engagement. As a result, different height motor casings could be used and, if desired, the motor casing could be shifted axially through the flange 156 for properly positioning the main suction fan 54 of a particular blow motor used with the vacuum cleaner.

The blow motor casing section 68 has entrance openings 72 at the top thereof for inlet of cooling air into the casing section 68. The motor casing is so placed that openings 72 into it open above the top wall 152 of the upper housing.

Outlet for cooling air from the motor casing section 68 is through the exhaust opening slots 74 at the bottom of the casing section 68. Tbe opening 154 and the depending flange 156 prevent the contaminated cooling air that has passed over the motor and out the exhaust outlet openings 74 from returning to the cooling air inlet openings 72.

The lower housing 30 and the upper housing 150 combine to separate the inflowing motor cooling air from the outflowing motor cooling air. The lower housing top wall 40 is closed, except for the opening 44 which is closed off by the flange 46 cooperating with the casing widened lower portion 58. The upper housing top wall 152 is also closed, except for the motor casing opening 154, and the below described motor cooling air exhaust outlet 160. As the bottom of the upper housing is open, the upper housing top wall 152 cooperates with the lower housing top wall 40 and the below described side wall flange 186 of the upper housing to define a closed expansion chamber (FIG. 2) having a smaller volume lower portion 157 inside the flange 44 which communicates with the much larger volume upper portion 158 inside the upper housing side wall flange 186. The expansion chamber extends around the motor casing section 68.

At one side of the hole 154 through the upper housing top wall 152, and radially a short distance beyond the flange 156, the only outlet for exhausted motor cooling air from the expansion chamber 157, 158 is provided. It comprises a generally crescent shaped opening 160 which is defined in the top wall 152.

An appropriately shaped baffle 400 defined atop the upper housing 150 beneath the cover 240 of the vacuum cleaner, described below, separates the openings 154 and 160 to prevent mixing of the inflowing and exhausting motor cooling air flows. Projecting up from and integrally molded to the top side of the upper housing top wall 152, the continuous baffle rib 400 has the constant height shown in FIG. 8 and has the profile illustrated in FIG. 7. The profile of the baffle rib 400 is selected to cooperate with the shapes and arrangements of the openings 154, 160 of the upper housing. In particular, the baffle rib 400 starts at the end 402 of the rib at the section 172 of the splash wall 166. The portion 404 of the rib 400 extends beyond the section 172 of the splash wall and past the end 406 of the opening 160. The curved section 408 of the baffle rib 400 is shaped to seat on the narrow section 410 of the top wall 152 of the upper housing, thereby to define a separating wall between the openings 154 and 160. The section 412 of the baffle rib 400 extends past the end 256 of the opening 160 in the upper housing and then merges into the splash wall section 168.

The height of the baffle rib 400 is greater than that of the splash walls 170, 175 as they perform different functions. The baffle rib extends all the way up to the cover wall as it must block air flow past it. The splash wall, on the other hand, blocks water or debris, but should not block air flow past itself, whereby it is shorter in height.

At one end of the upper housing top wall 152, there is a laterally projecting, slightly upwardly inclined flange 161 with a hole 162 through it. The flange 161 and the hole 162 provide cord protection and bend relief for the power cord 164 of the vacuum cleaner.

Projecting up above the top surface of the wall 152 is a relatively short height splash wall 166. The splash wall 166 has a straight portion 168 that extends along the edge of the flange 161 and up to the adjacent end of the crescent shaped opening 160. The wall 166 has a curved portion 170 that passes peripherally around the outside of the generally crescent shaped opening 160. The wall 166 has another straight portion 172 which extends toward the below described electrical box 206 at the opposite side of the upper housing from the flange 161. The splash wall 166 protects against water and debris splashing up under the cover 240 and into the crescent shaped opening 160.

There is a similar height splash wall 175 toward the opposite edge of the housing top wall. The wall 175 includes a short straight portion 176 that extends along the opposite edge of the flange 161, a curved portion 178 that passes generally around the periphery of the upper housing 150, a straight portion 179 that continues generally around the periphery of the housing and a curved portion 182 which completes the wall 175 around the periphery of the upper housing until the wall terminates at the below described electric box 206.

Various electrical components for the vacuum cleaner, known in the art and schematically illustrated by the box 185 sit upon the top of the upper housing top wall 152 in the section thereof between the splash wall 175 and the opening 154. These components are connected to the power cord 164, the motor 52 and the below described electrical panel 210, in a manner known in the art. The splash wall 175 close to the periphery of the upper housing 150 protects against water or debris splashing up under the cover 240 and on to any electrical connections or electrical apparatus that are seated atop the top wall 152 of the upper housing.

An annular, peripheral support flange 186 is defined at the underside of the top wall 152 near the periphery. It also passes under the depressed bottom wall 212 of the electrical box 206. As shown in FIG. 2, the flange 186 is so positioned at the underside of the upper housing as to extend down into the cord wrap slot depression 136 of the lower housing and so that its lower end portion seats against the lower wall 138 and against the radially inward wall 139 of the slot depression 136. The walls 138, 139 cooperate with the lower end portion 188 of the flange 186 for positioning the upper housing 150. The flange 186 also defines an enclosing side wall for the expansion chamber 157, 158.

A plurality of wells 194 extend beneath the underside of the top wall 152 of the upper housing, and these extend down to and normally seat upon the top of the upper wall 40 of the lower housing 30. Fastening screws 196 are passed down through the wells 194, through the narrowed openings 197 at the bottom of the wells 194, and through the aligned holes 198 formed in the top ends of the bosses 201 which are positioned and supported at the exterior of the above described flange 80 beneath the upper wall 40 of the lower housing 30. When the screws 196 are tightened into the openings 198 in the lower housing, this secures the upper and lower housings together.

Other screws, not shown, extend up through the tank lid 20 into the bottom of the openings 198 in the bosses 201 for holding the lower housing and the lid securely together, completing securement of the upper and lower housings to the lid and to the tank 10 of the vacuum cleaner.

The upper housing further includes an electrical box 206 which receives the electrical panel 210 that is installed in it from the front. The electrical panel may carry controls 212, such as a switch, and/or a power light, and/or an auxiliary electrical receptacle. The specifics of the electrical apparatus 185, 212 involved are not here shown, since they are known to persons skilled in the art. The controls 212 on the electrical panel are, in turn, connected to the electric components 185 and the electric components 185 are, insofar as necessary, connected with the blow motor 52, as is known to persons skilled in the art. The electrical box 206 is defined on its underside in the upper housing by the bottom wall 212, on its inward side by the inward wall 214, and by opposite side walls 216. The walls 212, 214, 216 assure that the side of the upper housing at which the box 206 is located is sealed against undesired entrance of water, debris, etc. and these walls maintain the closure of the expansion chamber 157, 158.

The electrical panel cover 220 shown in FIGS. 9, 10, 11 and 12 covers over the outwardly facing open side of the electrical box 206. It includes a slotted lower portion 222 which receives the forwardly projecting portion of the bottom wall 212 of the box 206. The front face 224 of the cover 220 covers over the front face of the electrical box 206. Except for the access holes 225 for the controls 212, the front face 224 seals the box. The roof 226 of the cover 220 closes off the top of the open topped box 206. Projecting fastening flanges 228 at the sides of the cover 220 permit the cover to be secured over the hollow bosses 232 supported on the upper housing by means of the fastening screws 234.

With reference to FIGS. 2, 9, 13 and 14, the cover 240 covers over the top of the upper housing 150 and cooperates with the above described baffle rib 400 to define means for separating the inlet flow of cooling air to the blow motor casing inlet openings 72 from the outlet flow of motor cooling air through the expansion chamber outlet 160. The cover includes the closed, flat, top wall 242. As shown in FIG. 9, the interior wall 214 of the electrical box 206 projects up past the edge 402 of the upstanding baffle rib 400. The top 226 of the electrical box cover engages the underside of the top wall 242 of the vacuum cleaner cover. As shown in FIG. 9, the baffle rib 400 extends up to and seats against the underside of the flat top wall 242 of the cover 240.

The cooperation between the baffle rib 400 at the upper surface of the top wall 152 and the cover top wall 242 separates the volume between the top wall 152 of the upper housing and the top wall 242 of the cover into two chambers, namely a chamber 260 which is outside the electrical box 206 and which communicates with the opening 154 in the upper housing for inflowing air for cooling of the motor, and the chamber 262 on the opposite side of the baffle rib 400, which is also outside the electrical box 206, for the cooling air which has been exhausted from the outlet 74 from the motor casing section 68 and through the opening 160.

It can be understood that the profile of the baffle rib 400 under the cover is selected to cooperate with the configuration and placement of the openings 154, 160. With differently shaped or placed openings 154, 160, an appropriate change is made in the profile of the baffle rib 400.

The cover includes a depending peripheral side wall 266. The cover has a greater diameter than the upper housing, and the side wall 266 thereby provides a clearance space 267 at the periphery of the cover for entry and for exit of air for cooling the motor via the chambers 260, 262.

The cover includes a downwardly depending extension portion 270 that overhangs the electric cord support flange 161 on the upper housing and defines an opening 272 for the electric power cord 164.

Figure 13:
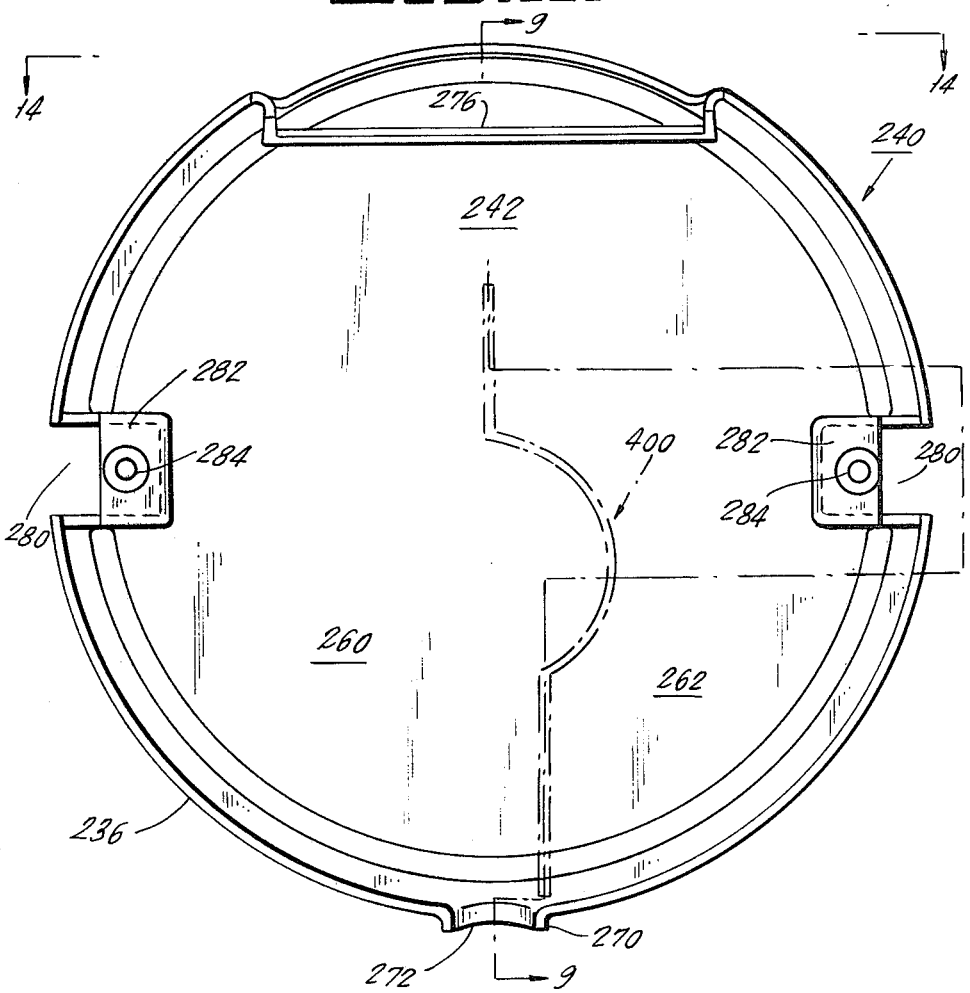
FIG. 13 is a bottom view of the cover over the upper housing and viewed in the direction of arrows 13—13 of FIG. 14.

The area 276 on the edge of the cover is shaped to cooperate with the electrical box 206, as shown in FIGS. 9 and 13.

The cutouts 280 on opposite sides of the cover have support flanges 282 defined in them through which openings 284 are provided. There is a generally U-shaped carrying handle 290 for the vacuum cleaner. A screw 292 passes through an opening 293 in the handle, then through an opening 284 in the cover, and the screw is tightened into the screw-threaded opening 294 in the boss 295 defined at the periphery of the top wall 152 of the upper housing 150. This holds the handle 290 to the cover and the upper housing, whereby the entire vacuum cleaner is held together as a combined unit.

Figure 16:
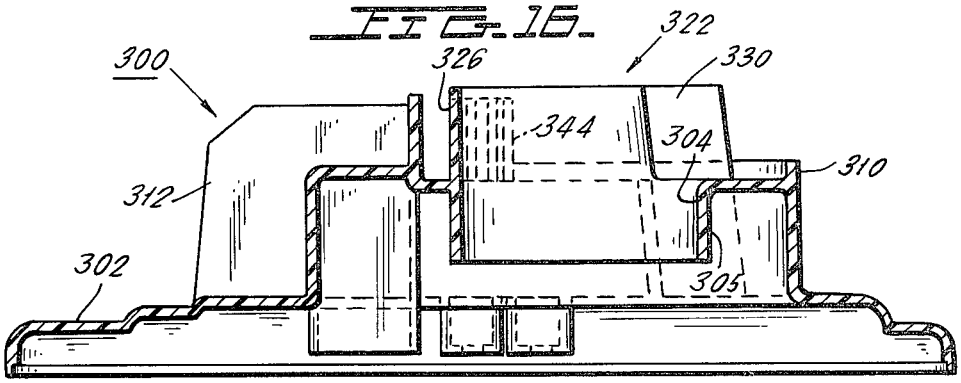
FIG. 16 is a cross sectional view of the upper housing of FIG. 15 along the line and in the direction of arrows 16—16 in FIG. 15.
Figure 15:
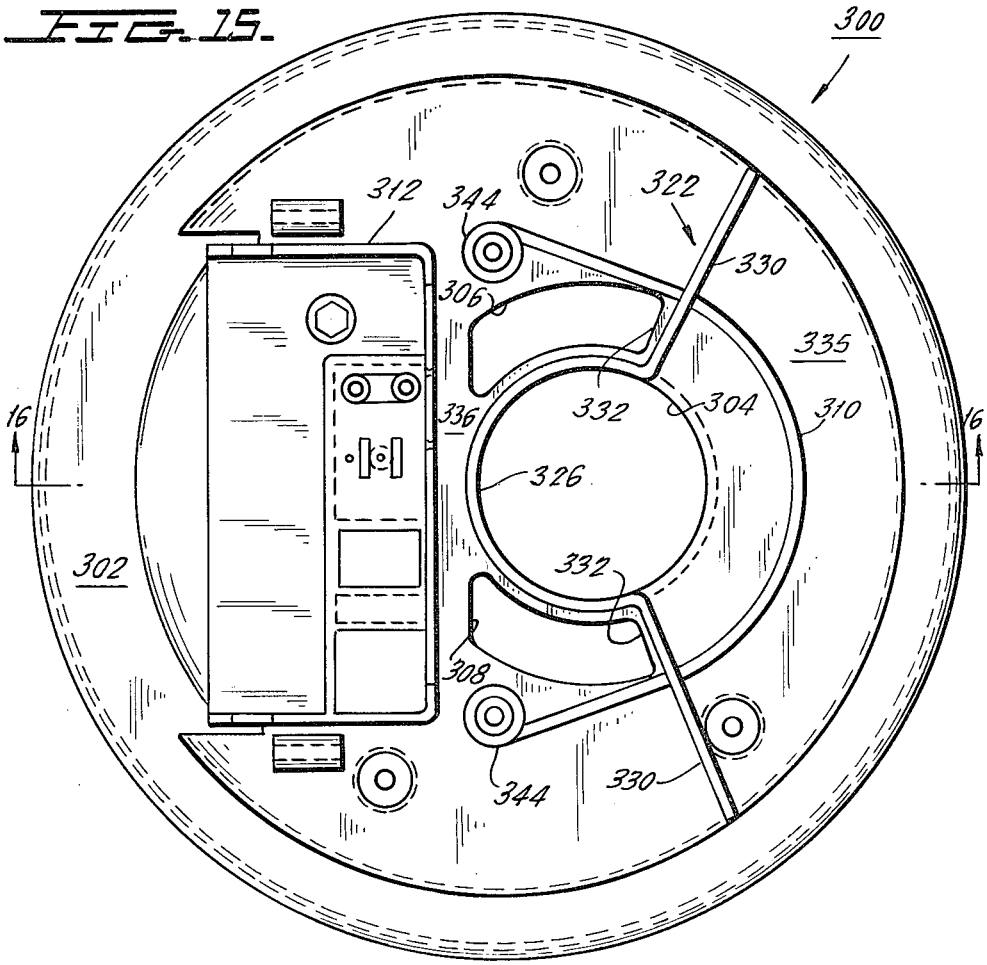
FIG. 15 is a top view of an alternate embodiment of an upper housing.
Figure 18:
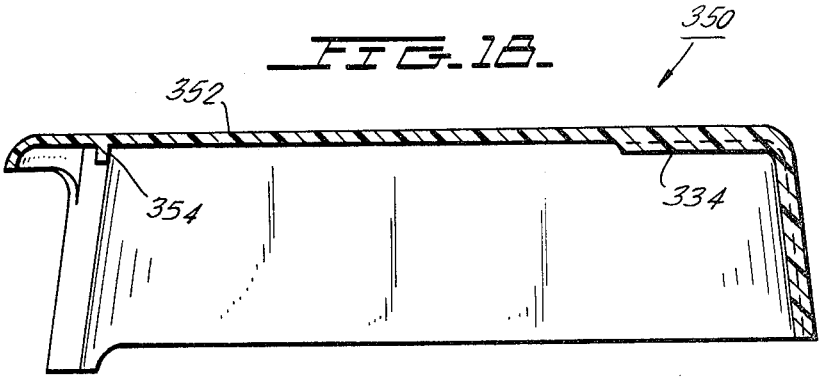
FIG. 18 is a cross-sectional view of the alternate embodiment of cover along the line and in the direction of arrows 18—18 in FIG. 17.
Figure 17:
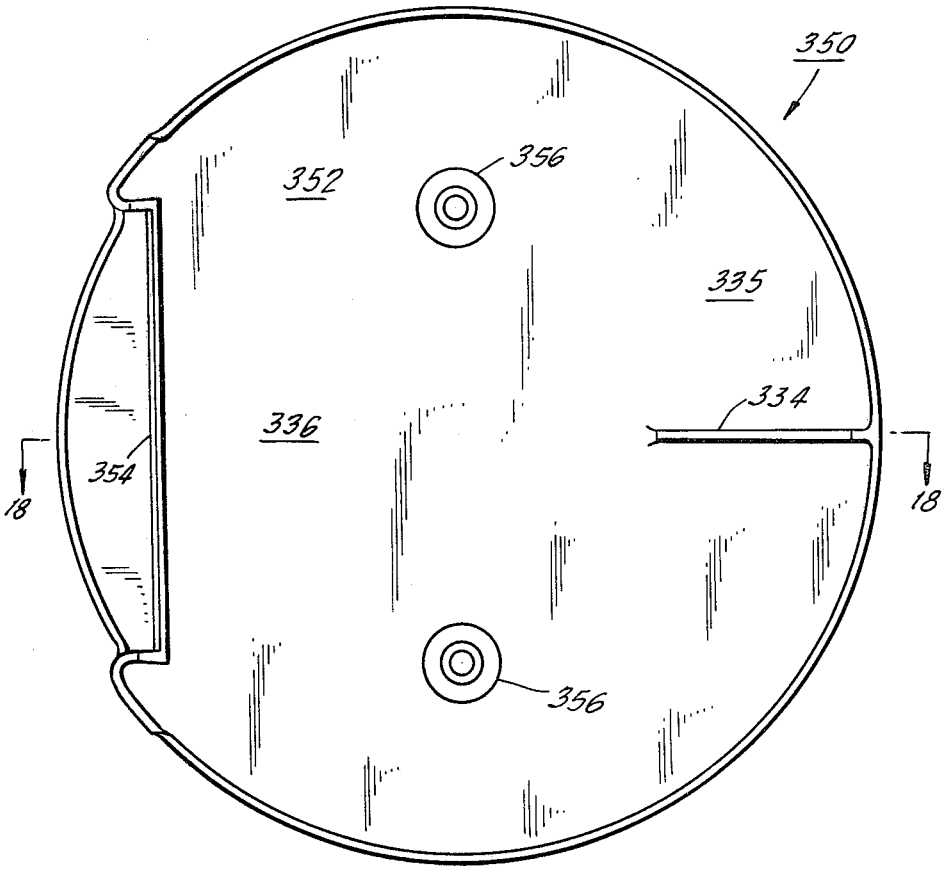
FIG. 17 is a bottom plan view of an alternate embodiment of cover for use in cooperation with the alternate embodiment of the upper housing.

Another embodiment of an upper housing 300 is shown in FIGS. 15 and 16 and a respective other embodiment of a cover 350 is shown in FIGS. 17 and 18. In the upper housing 300, there is a profiled top wall 302 having a blower motor cooling air inlet opening 304 for the cooling air for the motor casing. The narrow top portion of the motor casing is received in the depending flange 305 beneath the opening 304. However, instead of there being but a single crescent shaped opening 160 for the exhausting motor cooling air that is in the expansion chamber beneath the upper housing 300, there are two crescent shaped exhaust air openings 306, 308 at opposite sides of the cooling air inlet opening 304, whereby there are two exits from the expansion chamber beneath the upper housing.

Splash protection for both of the crescent shaped openings 306, 308 and for the inlet opening 304 is provided by the single curved splash wall 310 which projects above the housing and which extends almost to the electrical box 312.

To accomodate the different configuration of the inlet and outlet openings 304, 306, 308 through the upper housing, the modified upper housing 300 has an unusually curved baffle rib 322 integrally molded to and projecting up from the top wall 302 thereof. The section 326 of the baffle rib surrounds the section of the inlet opening 304 facing toward the electrical box 312 and extends over the narrow separating rims 328 located between the opening, 304, on the one hand, and openings 306, 308, on the other hand. The sections 330 of the baffle rib 322 extend past the ends 332 of the crescent openings 306, 308 and then extend out past the wall 310 which they intersect and out to the periphery of the cover. There is an additional cover strengthening rib 334 on the cover 350 that starts at the outside of the splash wall 310 and extends to the periphery of the cover 350. The cover 350 has a flat top wall 352 up to which the baffle rib 322 extends. As in the first embodiment, the baffle rib 322 is taller than the splash wall 310, since the baffle rib stops air flow across itself, while the splash wall is not designed for that, but only to stop splash into the openings 304, 306, 308.

By means of the baffle ribs 322, 334, two chambers are defined beneath the cover 350 and above the upper housing 300, namely the cooling air inlet chamber 335 at one side of the baffle rib 322 and the cooling air outlet chamber 336 at the other side of the baffle rib 322.

The cover 350 includes the cutout section 354 thereof for cooperating with the electrical box. Bosses 356 in the cover 350 overlie and are secured at bosses 344 above the upper housing for securing these two elements together.

Other features of the upper housing 300 and the cooperating cover 350 may be substantially the same as in the first embodiment and, therefore, are not further described. All of the other elements of the vacuum cleaner may be the same as in the first embodiment and they thus are not further described.

Although the present invention has been described in connection with preferred embodiments thereof, many variations and modifications will now become apparent to those skilled in the art. It is preferred, therefore, that the present invention be limited not by the specific disclosure herein, but only by the appended claims.

What is claimed is:

1. A blower motor and housing assembly for use at the air inlet to a vacuum cleaner, or the like, said assembly comprising:

a bypass type blower motor, including a motor casing; a drive motor in the casing; a main blower fan connected with the drive motor for being driven thereby; the main blower fan having an inlet side for transmission of air to the main blower fan and having an outlet side for air exhausted by the main blower fan;

the casing having a cooling air inlet at one side of the motor and having a cooling air outlet at the other side of the motor; a motor cooling air fan connected with the drive motor for blowing cooling air in the casing across the motor from the cooling air inlet through the cooling air outlet; casing separating means for separating the cooling air flow in the casing between the cooling air inlet and the cooling air outlet from the air flow transmitted past the main blower fan;

housing means for containing the blower motor and the casing thereof; the housing means having an inlet which communicates with the inlet side of the main blower fan; the housing means including a first expansion chamber communicating with the outlet side of the main blower fan and being large enough for and being shaped for slowing the velocity of the air blown into the first expansion chamber by the main blower fan; a first outlet from the first expansion chamber out of the housing means;

a second expansion chamber communicating with the cooling air outlet and being large enough for and being shaped for slowing the velocity of the air blown into the second expansion chamber by the motor cooling fan; a second outlet from the second expansion chamber and out of the housing means;

the housing means including first separating means for separating the first and second expansion chambers; second separating means for separating the first expansion chamber from the inlet to the main blower fan; and third separating means outside the motor casing for separating the air flow to the cooling air inlet and from the cooling air outlet;

said housing means being enclosed by an external wall; the first outlet comprising a wall opening through the housing means external wall; a tubular outlet fitting projecting into the first expansion chamber from the wall opening for defining a tubular exit pathway to the wall opening from the first expansion chamber; and a cuff of air flow velocity damping and noise and vibration damping material at and defining the tubular outlet fitting.

2. The assembly of claim 1, wherein the material of the cuff is a porous foamed material.

3. The assembly of claim 2, wherein the material of the cuff is a porous foamed plastic material.

4. The assembly of either of claims 1 or 2, further comprising a cage in and supporting the cuff and around which the cuff passes; the cage having openings therethrough for permitting access from within the tubular outlet fitting to the cuff.

5. The assembly of claim 1, wherein the first expansion chamber includes baffle means therein shaped for defining a generally gradually enlarging plenum in the first expansion chamber from the main blower fan outlet to the first outlet from the first expansion chamber.

6. The assembly of claim 5, wherein the baffle means is shaped to define a generally spiral pathway of generally gradually increasing cross-section from the main blower fan outlet to the first outlet.

7. The assembly of claim 6, wherein the housing means external wall is generally circular in cross-section around the first expansion chamber.

8. The assembly of claim 6, wherein the main blower fan is a centrifugal fan, having the outlet thereof around the periphery thereof.

9. The assembly of claim 8, wherein at least a portion of the baffle means passes at least partially around the periphery of the main blower fan at the outlet thereof and the plenum also generally gradually enlarges around the periphery of the main blower fan and continues to gradually generally enlarge beyond the portion of the baffle means passing at least partially around the main blower fan.

10. A blower motor and housing assembly for use at the air inlet to a vacuum cleaner, or the like, said assembly comprising:

a bypass type blower motor, including a motor casing; a drive motor in the casing; a main blower fan connected with the drive motor for being driven thereby; the main blower fan having an inlet side for transmission of air to the main blower fan and having an outlet side for air exhausted by the main blower fan;

the casing having a cooling air inlet at one side of the motor and having a cooling air outlet at the other side of the motor; a motor cooling fan connected with the drive motor for blowing cooling air in the casing across the motor from the cooling air inlet through the cooling air outlet; casing separating means for separating the cooling air flow in the casing between the cooling air inlet and the cooling air outlet from the air flow transmitted past the main blower fan;

housing means for containing the blower motor and the casing thereof; the housing means having an inlet which communicates with the inlet side of the main blower fan; the housing means including a first expansion chamber communicating with the outlet side of the main blower fan and being large enough for and being shaped for slowing the velocity of the air blown into the first expansion chamber by the main blower fan; a first outlet from the first expansion chamber out of the housing means;

a second expansion chamber communicating with the cooling air outlet and being large enough for and being shaped for slowing the velocity of the air blown into the second expansion chamber by the motor cooling fan; a second outlet from the second expansion chamber and out of the housing means;

the housing means including first separating means for separating the first and second expansion chambers; second separating means for separating the first expansion chamber from the inlet to the main blower fan; and third separating means outside the motor casing for separating the air flow to the cooling air inlet and from the cooling air outlet;

said first expansion chamber including second baffle means therein shaped for defining a gradually enlarging plenum in the first expansion chamber from the main blower fan outlet to the first outlet from the first expansion chamber.

11. The assembly of claim 10, wherein the second outlet from the second expansion chamber is directed in the same direction as the cooling air inlet; the third separating means comprises baffle means for separating the air flow from the second outlet and the air flow into the cooling air inlet.

12. The assembly of claim 11, wherein the housing means includes a cover over it; the second outlet and the cooling air inlet both face toward and are spaced away from the cover and the cover passes over them; the baffle means extends across the space under the cover and passes between the second outlet and the cooling air inlet; the cover being shaped to permit both the air flow to the cooling air inlet and the air flow from the second outlet to pass under the cover to and from the cooling air inlet and the second outlet, respectively.

13. In combination, the assembly of claim 1 and a tank for collected materials; an inlet to the tank; an outlet from the tank; the tank outlet communicating with the inlet side of the main blower fan for creating suction at the tank inlet;

the first expansion chamber being positioned above the tank, and the second expansion chamber being positioned above the first expansion chamber.

14. The combination of claim 13, wherein the second outlet from the second expansion chamber is directed in the same direction as the cooling air inlet; the third separating means comprising baffle means for separating the air flow from the second outlet and the air flow into the cooling air inlet;

the housing means includes a top cover over the top of it; the second outlet and the cooling air inlet both face up toward and are spaced away from the cover and the cover passes over them; the baffle means extends across the space under the cover and passes between the second outlet and the cooling air inlet; the cover being shaped to permit both the air flow to the cooling air inlet and the air flow from the second outlet to pass under the cover to and from the cooling air inlet and the second outlet, respectively.

15. The combination of claim 14, wherein the top cover is above the second expansion chamber, and the second outlet and the cooling air inlet both are directed upwardly.

16. The assembly of claim 15, further comprising a lid over the tank; the first expansion chamber being defined above the lid.

17. The assembly of claim 16, wherein the first separating means comprises a lower housing above the lid and the lower housing being shaped for defining the first expansion chamber inside the lower housing and above the lid; the lower housing engaging the casing of the motor at a location on the casing for defining the second separating means;

an upper housing disposed above the lower housing; said upper housing having said third separating means and being shaped for defining the second expansion chamber.

18. A blower motor and housing assembly for use at the air inlet to a vacuum cleaner, or the like, said assembly comprising:

a bypass type blower motor, including a motor casing; a drive motor in the casing; a main blower fan connected with the drive motor for being driven thereby; the main blower fan having an inlet side for transmission of air to the main blower fan and having an outlet side for air exhausted by the main blower fan;

the casing having a cooling air inlet at one side of the motor and having a cooling air outlet at the other side of the motor; a motor cooling fan connected with the drive motor for blowing cooling air in the casing across the motor from the cooling air inlet through the cooling air outlet; casing separating means for separating the cooling air flow in the casing between the cooling air inlet and the cooling air outlet from the air flow transmitted past the main blower fan;

housing means for containing the blower motor and the casing thereof; the housing means having an inlet which communicates with the inlet side of the main blower fan; the housing means including a first expansion chamber communicating with the outlet side of the main blower fan and being large enough for and being shaped for slowing the velocity of the air blown into the first expansion chamber by the main blower fan; a first outlet from the first expansion chamber out of the housing means;

a second expansion chamber communicating with the cooling air outlet and being large enough for and being shaped for slowing the velocity of the air blown into the second expansion chamber by the motor cooling fan; a second outlet from the second expansion chamber and out of the housing means;

the housing means including first separating means for separating the first and second expansion chambers; second separating means for separating the first expansion chamber from the inlet to the main blower fan; and third separating means outside the motor casing for separating the air flow to the cooling air inlet and from the cooling air outlet;

a tank for collected materials; an inlet to the tank; an outlet from the tank; the tank outlet communicating with the inlet side of the main blower fan for creating suction at the tank inlet;

a lid over the tank; the first expansion chamber being defined above the lid;

a lower housing above the lid and the lower housing being shaped for defining the first expansion chamber inside the lower housing and above the lid; the lower housing engaging the casing of the motor at a location on the casing for defining the second separating means.

19. The combination of claim 18, wherein the lower housing is enclosed by an external wall; the first outlet comprises a wall opening through the lower housing external wall; a tubular outlet fitting projecting into the lower housing from the wall opening for defining a tubular exit pathway to the wall opening from inside the lower housing;

a cuff of air flow velocity damping and noise and vibration damping material at and defining the tubular outlet fitting.

20. The combination of claim 19, wherein the lower housing includes baffle means therein shaped for defining a generally gradually enlarging plenum in the first expansion chamber from the main blower fan outlet to the first outlet from the first expansion chamber.

21. The combination of claim 20, wherein the baffle means is shaped to define a generally spiral pathway of generally gradually increasing cross-section from the main blower fan outlet to the first outlet.

22. The combination of claim 21, wherein the main blower fan is a centrifugal fan, having the outlet thereof around the periphery thereof; at least a portion of the baffle means passes at least partially around the periphery of the main blower fan at the outlet thereof and the plenum also generally gradually enlarges around the periphery of the main blower fan.

23. The combination of claim 18, wherein the second outlet from the upper housing is directed in the same direction as the cooling air inlet; the third separating means comprise baffle means for separating the air flow from the second outlet and the air flow into the cooling air inlet;

a top cover over the top of the upper housing; the second outlet and the cooling air inlet both facing up toward and being spaced away from the cover which passes over them; the baffle means extending across the space under the cover and passing between the second outlet and the cooling air inlet; the cover being shaped to permit both the air flow to the cooling air inlet and the air flow from the second outlet to pass under the cover to and from the cooling air inlet and the second outlet, respectively.

24. A blower motor and housing assembly for use at the air inlet to a vacuum cleaner, or the like, said assembly comprising:

a bypass type blower motor, including a motor casing; a drive motor in the casing; a main blower fan connected with the drive motor for being driven thereby; the main blower fan having an inlet side for transmission of air to the main blower fan and having an outlet side for air exhausted by the main blower fan;

the casing having a cooling air inlet at one side of the motor and having a cooling air outlet at the other side of the motor; a motor cooling fan connected with the drive motor for blowing cooling air in the casing across the motor from the cooling air inlet through the cooling air outlet; casing separating means for separating the cooling air flow in the casing between the cooling air inlet and the cooling air outlet from the air flow transmitted past the main blower fan;

housing means for containing the blower motor and the casing thereof; the housing means having an inlet which communicates with the inlet side of the main blower fan; the housing means including a first expansion chamber communicating with the outlet side of the main blower fan and being large enough for and being shaped for slowing the velocity of the air blown into the first expansion chamber by the main blower fan; a first outlet from the first expansion chamber out of the housing means;

a second outlet communicating with the cooling air outlet and out of the housing means;

the housing means including first separating means for separating the first expansion chamber from the cooling air outlet and the second outlet; second separating means for separating the first expansion chamber from the inlet to the main blower fan; and third separating means outside the housing means for separating the air flow to the cooling air inlet from the airflow from the cooling air outlet;

said housing means being enclosed by an external wall; the first outlet comprises a wall opening through the housing means external wall; a tubular outlet fitting projecting into the lower housing from the wall opening for defining a tubular exit pathway to the wall opening from the lower housing;

a cuff of air flow velocity damping and noise and vibration damping material at and defining the tubular outlet fitting.

25. In combination, the assembly of claim 24 and a tank for collected materials; an inlet to the tank; an outlet from the tank; the tank outlet communicating with the inlet side of the main blower fan for creating suction at the tank inlet.

26. The assembly of claim 24, wherein the first expansion chamber includes baffle means therein shaped for defining a generally gradually enlarging plenum in the first expansion chamber from the main blower fan outlet to the first outlet from the first expansion chamber.

27. The assembly of claim 26, wherein the baffle means is shaped to define a generally spiral pathway of generally gradually increasing cross-section from the main blower fan outlet to the first outlet.

28. The assembly of claim 27, wherein the main blower fan is a centrifugal fan, having the outlet thereof around the periphery thereof; at least a portion of the baffle means passes at least partially around the periphery of the main blower fan at the outlet thereof and the plenum also generally gradually enlarges around the periphery of the main blower fan and continues to gradually generally enlarge beyond the portion of the baffle means passing at least partially around the main blower fan.

* * * * *